United States Patent [19]

Hermanson

[11] 4,344,206

[45] Aug. 17, 1982

[54] BRACKET AND DOOR TRACK ASSEMBLY

[75] Inventor: Lars Hermanson, Scarborough, Canada

[73] Assignee: Clark Door Company, Inc., Cranford, N.J.

[21] Appl. No.: 123,262

[22] Filed: Feb. 21, 1980

[51] Int. Cl.[3] ..... E05D 15/06

[52] U.S. Cl. ..... 16/94 R

[58] Field of Search ..... 16/87 R, 87.4 R, 87.4 W, 16/87.6 R, 87.6 W, 94 R, 94 D, 95 R, 95 W, 95 D, 95 DW, 91; 160/345

[56] References Cited

U.S. PATENT DOCUMENTS

| | | | |
|---|---|---|---|
| 509,650 | 11/1893 | Brodie | 16/94 R |
| 725,136 | 4/1903 | Prouty | 16/94 R |
| 891,369 | 6/1908 | Prouty | 16/94 R |
| 1,945,332 | 1/1934 | Robinson | 16/94 R |
| 3,129,751 | 4/1964 | Weber | 160/345 |
| 3,183,546 | 5/1965 | Heller et al. | 16/94 D |
| 3,431,585 | 3/1969 | Foltz | 16/94 D |
| 3,514,806 | 6/1970 | Klein | 16/94 D |
| 3,823,439 | 7/1974 | Selset | 16/95 D |

FOREIGN PATENT DOCUMENTS

| | | | |
|---|---|---|---|
| 253159 | 3/1967 | Austria | 16/94 D |

*Primary Examiner*—Wm. Carter Reynolds

*Attorney, Agent, or Firm*—Cohn, Powell & Hind

[57] ABSTRACT

This bracket and track assembly can be used for sliding door assemblies and facilitates the alignment and installation of such doors. The track includes a pair of spaced, inwardly facing channel-shaped track members, supported by a plurality of longitudinally spaced, U-shaped bracket members embracingly disposed about said track members. The upper portion of each bracket member includes a rotatably mounted locking clip and a pair of arcuate slots receiving opposed legs of the clip. The arcuate slots overlap the upper, inner edges of each track member so that the clip legs exert an outward force against the track members when the clip is rotated, tending to urge said track members into engagement with said bracket members.

6 Claims, 5 Drawing Figures

BRACKET AND DOOR TRACK ASSEMBLY

BACKGROUND OF THE INVENTION

This invention relates generally to a bracket and track assembly and particularly to an assembly which can be installed without conventional fasteners and, in one aspect, is used for sliding door assemblies.

Tracks which are used for sliding doors and the like must be mounted or suspended above the doors. Because of this there are considerable problems in aligning the tracks not only laterally but also longitudinally. It will be readily understood that there is a considerable disadvantage making lengthwise adjustments which are dependent on the alignment of bolt openings. In addition, conventional fasteners are easily mislaid and can be loosened by vibration under the operational conditions of some sliding doors.

The present bracket and track assembly overcomes these and other problems in a manner not disclosed by the known prior art.

SUMMARY OF THE INVENTION

This bracket and track assembly provides a means for aligning and attaching a track to a bracket without the use of conventional fasteners. It is particularly useful for the installation of tracks used for sliding door assemblies.

The bracket and track assembly includes at least one track member having an upper portion providing a longitudinal engagement means; a lower portion, and a web portion connecting said upper and lower portions. The assembly also includes a bracket member disposed in embracing relation about said track member and including an upper portion extending beyond said track upper portion engagement means; a lower portion supporting said track member lower portion and at least one web portion interconnecting said upper and lower portions. The bracket member is provided with locking means rotatably mounted to said bracket upper portion and including an engagement portion rotatable into engagement with said track upper portion engagement means tending to urge said track member into engagement with said bracket member.

In one aspect of the invention, the track member web portion is spaced from the bracket member web portion and at least one pad is disposed between said web portions, intermediate said upper and lower portions, tending to move said track lower portion in one direction, into engagement with said bracket lower portion, when said track upper portion is moved in the other direction.

In another aspect of the invention, the bracket upper portion includes a slot overlappingly related to the track longitudinal engagement means and the locking means includes a rotatable camming member having a radial arm portion and a depending leg porton extending through said slot and providing said engagement portion.

According to an important aspect of the invention, the track includes a pair of generally channel-shaped, inwardly facing track members the lower portions having longitudinal engagement means disposed in spaced side-by-side relation, and the bracket member is U-shaped having an upper portion extending over the upper portions of both track members, a pivot axis being disposed between said track upper portion longitudinal engagement means; said bracket member also including a pair of inwardly turned lower portions each having a stop means disposed adjacent one of said track lower engagement means, and said bracket member also including a pair of web portions connecting said lower portions to said upper portions. Locking means is provided including a pair of engagement portions disposed on opposite sides of said pivot axis, each engagement portion being rotatable into engagement with one of said track upper portion engagement means.

According to another aspect of the invention, the bracket member upper portion includes opposed arcuate slots overlappingly related to said track upper longitudinal engagement means, and said locking means includes a camming member having depending legs received by said slots and providing said engagement portions.

According to another aspect of the invention, the camming member is generally U-shaped and includes a bight portion connecting said depending legs, the bight portion including means for turning said camming member.

According to yet another aspect of the invention, said track member web portions are inwardly spaced from said bracket web portions, and at least one pad is disposed between said spaced web portions tending to urge said track lower portions in one direction when said track upper portions are urged in the opposite direction.

In yet aother aspect of the invention, the pads between the track member and bracket member are of resilient material.

In still another aspect of the invention, each of said bracket lower portions includes upturned portions providing said bracket stop means, and each of said track lower portions includes an upturned portion providing said track longitudinal engagement means.

In another aspect of the invention, each of said track web portions includes an inwardly inclined lower portion facilitating installation of said track.

DESCRIPTION OF THE PREFERRED EMBODIMENT

Figure 1:
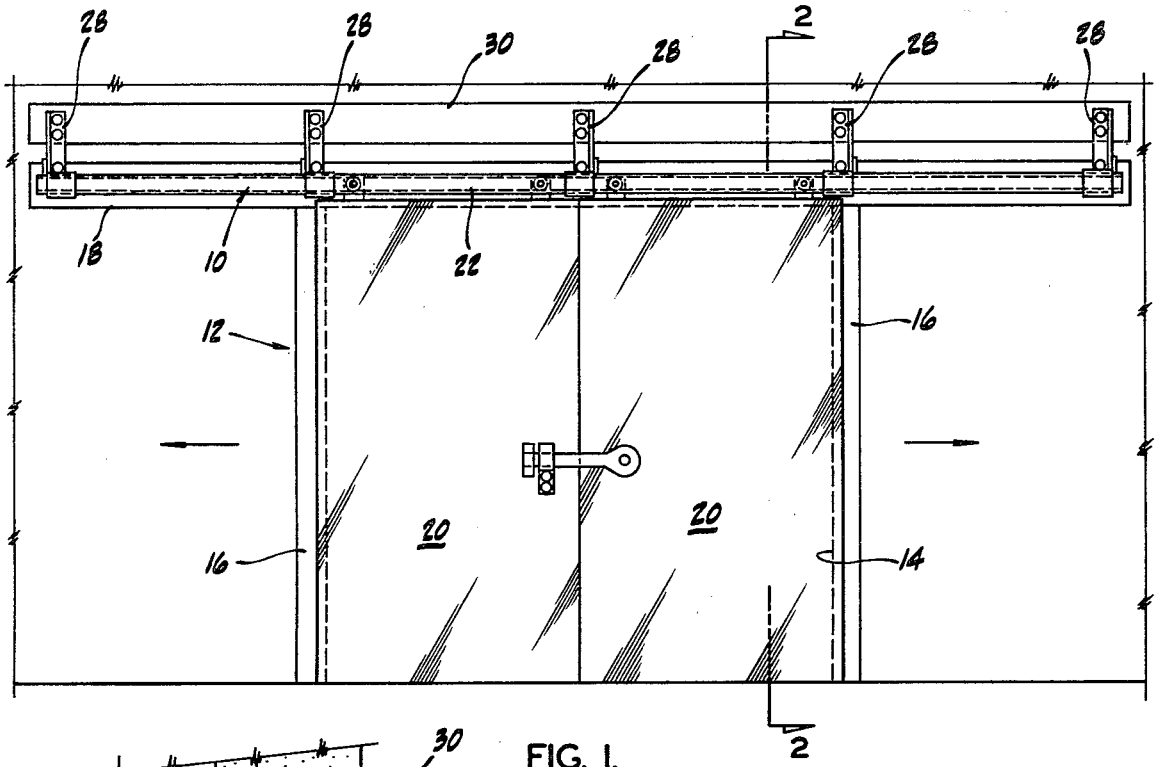
FIG. 1 is a front elevational view of a sliding door system using the bracket and track assembly.
Figure 2:
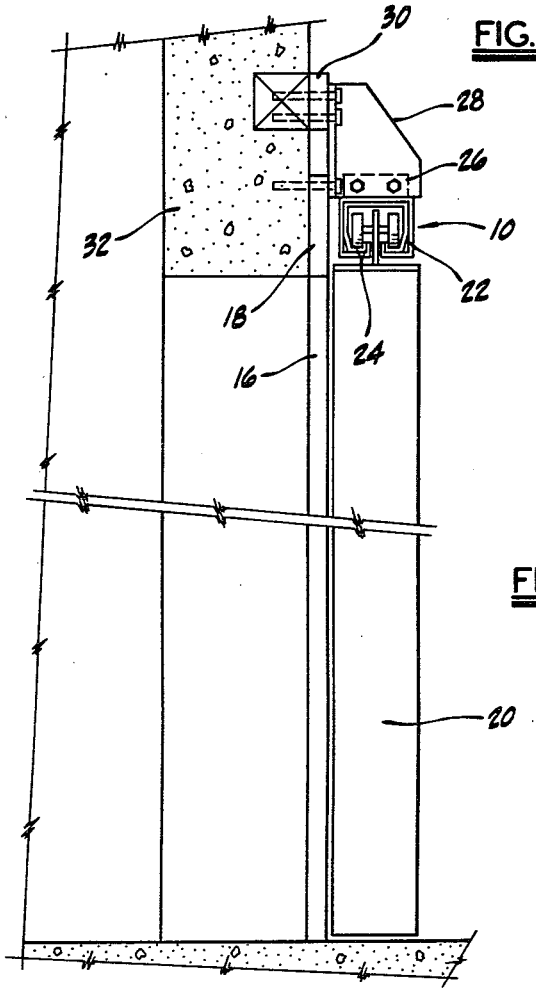
FIG. 2 is an enlarged cross sectional view taken through line 2—2 of FIG. 1.

Referring now by reference numerals to the drawings and first to FIGS. 1 and 2, it will be understood that the bracket and track assembly is generally indicated by numeral 10 and, in the preferred embodiment, is used in conjunction with a sliding door system 12.

As shown in FIG. 1, the sliding door system 12 is provided for an opening 14, which is framed by side and upper casing members 16 and 18, the door consisting of a pair of oppositely sliding door panels 20 suspended from a track 22. As shown in FIG. 2, each sliding panel 20 is provided with a roller assembly 24 carried by the track 22. The track 22 is supported by a plurality of bracket members 26 suspended from overhead brackets 28, which are attached to a header 30, carried by the wall 32. The bracket and track assembly 10 will now be described with greater particularity, with reference to FIGS. 3 through 5.

Figure 3:
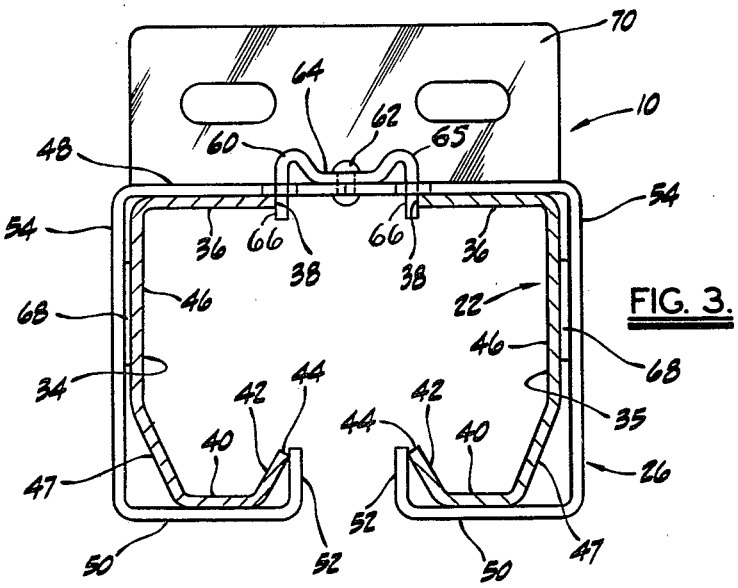
FIG. 3 is an enlarged cross sectional view of the bracket and track assembly.

As clearly shown in FIG. 3, the track 22 consists essentially of a pair of oppositely formed track members 34 and 35. Each track member includes an inwardly turned transverse upper portion 36 having a longitudinal margin portion 38, and an inwardly turned transverse lower portion 40 having an upturned, inclined end 42 terminating in a longitudinal margin portion 44, said margin portions constituting engagement means. The upper and lower portions are interconnected by a web portion 46 having an inclined portion 47.

The bracket members 26 are generally U-shaped and each is embracingly disposed about said track members 34 and 35. Each bracket member 26 includes a transverse upper portion 48, a pair of transverse, oppositely disposed, inwardly turned lower portions 50, having upwardly turned end portions 52 disposed in side-by-side relation, said end portions constituting stop means adjacent to and engageable with said longitudinal margin portions 44 of the track lower portions 40. The upper and lower portions 48 and 50 are interconnected by web portions 54, said lower portions supporting said track members.

Figure 4:
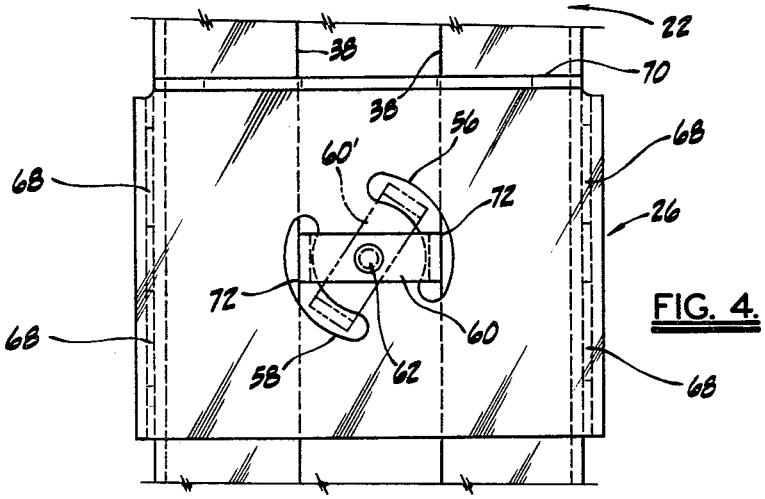
FIG. 4 is a plan view thereof.
Figure 5:
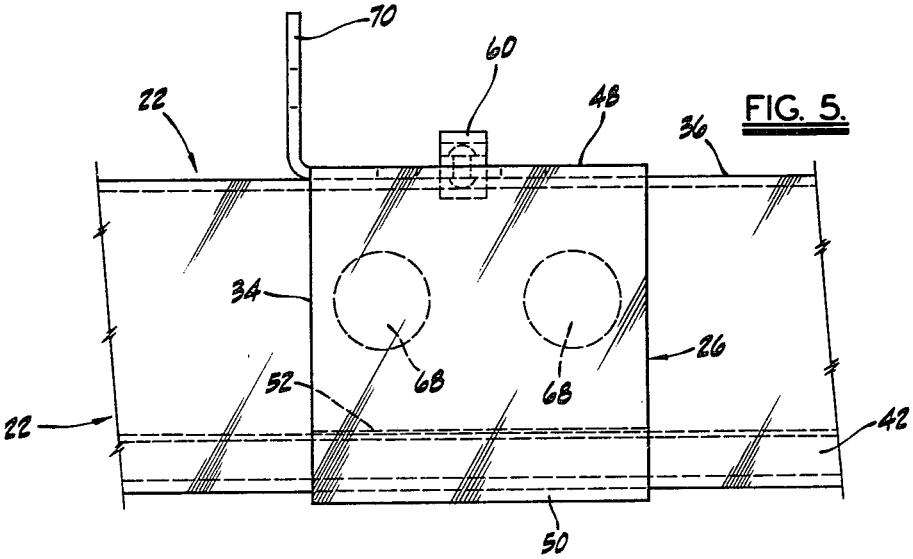
FIG. 5 is a side elevational view thereof.

As shown in FIG. 4, the upper portion 48 of each bracket member 24 includes a pair of arcuate slots 56 and 58. In the preferred embodiment, slots 56 and 58 are disposed on opposite sides of the longitudinal axis of the track centered between said track members 34 and 35, and have their longest portion disposed on each side of the transverse axis intersecting the center of the circle defining said slots 56 and 58. In the embodiment shown in FIG. 4, each arcuate slot extends from substantially the longitudinal axis to a point about fifteen degrees (15°) beyond the transverse axis. The width of the slots, as clearly shown in FIG. 4, overlaps the longitudinal margin portions 38 of the track member upper portions. Importantly, a locking means, provided by a camming member in the form of a generally U-shaped clip 60, is rotatably mounted to the transverse upper portion 48 by means of a rivet 62. As clearly shown in FIG. 3, the clip 60 includes a bight portion 64 having upturned ends 65, and a pair of downwardly depending legs 66 which project through the opposed arcuate slots 56 and 58. The legs 66 provide engagement means and are engageable with the track margin portions 38 upon rotation of said clip 60 into a position generally perpendicular to the longitudinal axis of the track 22 said clip being turned by means of said upturned ends 65.

The distance from the center of rotation of the clip 60, to the outer edges of the clip legs 66 providing the engagement portions, is greater than the perpendicular distance of the longitudinal margins 38 from the longitudinal axis of the track 22 when the clip is in the position shown in phantom outline by 60'. This structural arrangement of parts provides that when the clip 60 is moved into a perpendicular position the legs 66 tend to move each track upper portion 36 away from said longitudinal axis. This movement of the upper portions 36 is resisted by a pair of resilient bumper pads 68, which are disposed between the spaced web portions 46 and 54 of the track and bracket members respectively and are attached to said bracket members as by adhesive.

As will be understood from FIG. 3, the tendency of the track upper portions 36 to move away from the longitudinal axis of the track 22 results in a tendency for the track lower portions 40 to move toward said longitudinal axis because of the tendency of the track members 34 and 35 to pivot about the bumper pads 68. This pivotal action results in a pressure engagement between the track lower longitudinal margin 44 against the stop means provided by the upwardly turned portion 52 of the bracket member 26.

The installation of the bracket and track assembly 10 is believed to be fully understood from the foregoing description of parts but for completeness of disclosure will be briefly described with respect to a sliding door assembly 12.

The installation consists essentially of mounting a plurality of bracket members 26 to associated wall brackets 28 by bolting said upstanding bracket mounting portions 70 to said wall bracket 28, said bracket members and wall brackets constituting a support means. With the bracket members 26 in place, and the clips 60 of each bracket rotated in a counterclockwise position, as shown in phantom outline by 60' in FIG. 4, it becomes a relatively simple matter to thread each of the track members 34 and 36 into place, with the webs 46 substantially horizontal if desired, and then rotate said members into the position shown in FIG. 3, such track members being configurated to facilitate camming into place. Once the track members 34 and 35 have been correctly aligned and longitudinally located, it is merely a matter of rotating the clips 60 in a clockwise direction so that the legs 66 engage the longitudinal margins 38. Continued rotation of the clip 60 urges the track upper portions 36 away from the longitudinal axis until the clip is substantially perpendicular to the longitudinal axis of the track and exerts a force against the upper margin portions 38. This results in a pivoting action of the track members 34 and 35 about the bumper pads 68 and produces movement of the lower track longitudinal margins 44 against the bracket member upturned ends 52 thereby clamping the track members 34 and 35 in place into a locked position. The relatively flat configuration of the outer face of the clip 60 results in maximum movement of the track upper portions 36 away from the longitudinal axis when the clip corners 72 are perpendicular to the longitudinal axis. Further movement of the clip 60, until the compatible flat faces of the clip 60 are parallel with margins 38 results in a slight return of the track upper portions 36 and precludes any tendency for the clip to rotate out of position. As will be readily understood the length of the clip legs 66 provides said legs with some resilience which also facilitates the frictional clamping and locking action.

I claim as my invention:

1. A bracket and track assembly comprising:

(a) a track including at least one track member, said track member including:
   1. a transverse upper portion having a longitudinal margin portion,
   2. a transverse lower portion, and
   3. a web portion interconnecting said upper and lower portions of the track member, (b) a bracket member disposed in embracing relation about said track member and including:
   1. a transverse upper portion extending beyond said track upper portion longitudinal margin portion,
   2. a transverse lower portion supporting said track member lower portion,
   3. at least one web portion interconnecting said upper and lower portions of the bracket member, and
   4. locking means rotatably mounted to said upper portion of the bracket member, said locking means including engagement means rotatable into lateral engagement with said track upper portion longitudinal margin portion and tending to urge said track member into engagement with said bracket member, (c) said track member web portion being spaced from said bracket member web portion, and (d) at least one pad being disposed between said web portions of the track member and bracket member intermediate said upper and lower portions of the track member and bracket member tending to move said track lower portion laterally in one direction into engagement with said bracket lower portion when said track upper portion is moved laterally in the opposite direction upon lateral engagement of the locking engagement means with the longitudinal margin portion of the track upper portion.

2. A bracket and track assembly comprising:

(a) a track including at least one track member, said track member including:

1. a transverse upper portion having a longitudinal margin portion,
2. a transverse lower portion, and
3. a web portion interconnecting said upper and lower portions of the track member, (b) a bracket member disposed in embracing relation about said track member and including:

1. a transverse upper portion extending beyond said track upper portion longitudinal margin portion,
2. a transverse lower portion supporting said track member lower portion,
3. at least one web portion interconnecting said upper and lower portions of the bracket member, and
4. locking means rotatably mounted to said upper portion of the bracket member, said locking means including engagement means rotatable into lateral engagement with said track upper portion longitudinal margin portion and tending to urge said track member into engagement with said bracket member, (c) the bracket upper portion including a slot overlappingly related to said track longitudinal margin portion, and (d) said locking means including a camming member having a radial arm portion and a depending leg portion extending through said slot and laterally engaging the longitudinal margin portion.

3. A bracket and track assembly comprising:

(a) a track including a pair of track members disposed in spaced side-by-side relation, each track member including:

1. an inwardly turned upper portion having a longitudinal engagement means,
2. an inwardly turned lower portion having a longitudinal engagement means, and
3. a web portion interconnecting said upper and lower portions, (b) a generally U-shaped bracket member embracingly disposed about said track members and including:

1. an upper portion providing a pivot axis disposed between said track upper portion longitudinal engagement means,
2. a pair of oppositely disposed, inwardly turned lower portions, each having stop means disposed adjacent one of said track lower portion longitudinal engagement means,
3. a pair of web portions interconnecting said upper and lower portions, and
4. locking means rotatably mounted to said upper portion for rotation about the pivot axis, said locking means including a pair of oppositely disposed engagement means rotatable into engagement with one of said track upper portion longitudinal engagement means tending to urge said track members into engagement with said bracket member, (c) the bracket member upper portion including opposed arcuate slots overlappingly related to said track upper longitudinal engagement means, and (d) the locking means including a camming member having depending legs being received by said slots and providing said engagement means.

4. An assembly as defined in claim 3, in which:

(e) said camming member is generally U-shaped and includes a bight portion connecting said legs, said bight portion including means for turning said camming member.

5. A bracket and track assembly comprising:

(a) a track including a pair of track members disposed in spaced side-by-side relation, each track member including:

1. an inwardly turned transverse upper portion having a longitudinal margin portion, said longitudinal margin portions of the upper portions of the pair of track members being laterally spaced,
2. an inwardly turned transverse lower portion having a longitudinal margin portion, and
3. a web portion interconnecting said upper and lower portions of the track member, (b) a generally U-shaped bracket member embracingly disposed about said track members and including:

1. a transverse upper portion providing a pivot axis disposed between the longitudinal margin portions of the track upper portions of the track members,
lower portions, each having stop means disposed laterally adjacent the longitudinal margin portion of one of said track lower portions,
3. a pair of web portions interconnecting said upper and lower portions of the bracket member, and
4. locking means rotatably mounted to said upper portion of the bracket member for rotation about the pivot axis, said locking means including a pair of oppositely disposed engagement means rotatable into lateral engagement with the longitudinal margin portions of the track upper portions and tending to urge said track members laterally into engagement with said bracket member, (c) said track member web portions being inwardly spaced from said bracket web portions, and (d) at least one resilient pad being disposed between said spaced adjacent track and bracket web portions tending to urge said track lower portions inwardly and laterally toward each other when the track upper portions are urged outwardly and laterally away from each other.

6. In a sliding door assembly:

(a) a track including a pair of track members disposed in spaced side-by-side relation, each track member including:

1. an inwardly turned upper portion having a longitudinal margin portion, 2. an inwardly turned lower portion having a longitudinal margin portion,
3. a web portion interconnecting said upper and lower portions, and (b) a support means including a plurality of generally U-shaped bracket members, embracingly disposed about said track members, each bracket member including:

1. an upper portion providing a pivot axis disposed between said track upper portion longitudinal margin portions, and a pair of opposed arcuate slots disposed in overlapping relation to said longitudinal margin portions,
2. a pair of oppositely disposed inwardly turned lower portions, each having upwardly turned longitudinal margin portions disposed adjacent one of said track lower portion longitudinal margin portions,
3. a pair of web portions interconnecting said upper and lower portions, said web portions being spaced from the web portions of said track members,
4. opposed pads disposed between said spaced adjacent track and bracket web portions intermediate said upper and lower portions of the track and bracket members, and
5. a U-shaped camming member including a pin rotatably mounting said camming member to said upper portion of the bracket member for rotation about the pivot axis, said camming member including a pair of oppositely disposed engagement portions depending through the arcuate slots and rotatable into engagement with said track upper portion longitudinal margin portions tending to urge said track upper portions laterally away from each other, and tending to urge said track lower portions laterally into engagement with the upwardly turned longitudinal margin portions of said bracket lower portions, and (c) a sliding door panel having rollers at the upper end, rotatably mounted to the track for movement of the door longitudinally of the track.

* * * * *

UNITED STATES PATENT AND TRADEMARK OFFICE

CERTIFICATE OF CORRECTION

PATENT NO. : 4,344,206

DATED : August 17, 1982

INVENTOR(S) : Lars Hermanson

It is certified that error appears in the above-identified patent and that said Letters Patent are hereby corrected as shown below:

Column 1, line 56 after the word leg delete "porton" and insert --portion--

Column 6, line 41 before "lower" add --2. a pair of oppositely disposed, inwardly turned--

Signed and Sealed this

Nineteenth Day of October 1982

[SEAL]

Attest:

GERALD J. MOSSINGHOFF

Attesting Officer

Commissioner of Patents and Trademarks